US010052597B2

(12) United States Patent
Van Der Kooij

(10) Patent No.: US 10,052,597 B2
(45) Date of Patent: Aug. 21, 2018

(54) MIXING PADDLE

(71) Applicant: EMM Holding BV, Zwolle (NL)

(72) Inventor: Thomas Van Der Kooij, Zwolle (NL)

(73) Assignee: EMM HOLDING BV, Zwolle (NL)

( * ) Notice: Subject to any disclaimer, the term of this patent is extended or adjusted under 35 U.S.C. 154(b) by 435 days.

(21) Appl. No.: 14/637,021

(22) Filed: Mar. 3, 2015

(65) Prior Publication Data

US 2016/0136595 A1 May 19, 2016

(30) Foreign Application Priority Data

Nov. 19, 2014 (EP) ..... 14193821

(51) Int. Cl.

| | |
|---|---|
| ***B01F 7/00*** | (2006.01) |
| ***B01F 13/00*** | (2006.01) |
| ***B44D 3/06*** | (2006.01) |
| ***B44D 3/16*** | (2006.01) |

(52) U.S. Cl.

CPC ..... *B01F 7/0025* (2013.01); *B01F 7/00033* (2013.01); *B01F 13/002* (2013.01); *B44D 3/06* (2013.01); *B44D 3/16* (2013.01); *B01F 2215/005* (2013.01)

(58) Field of Classification Search

CPC ..... B01F 2215/005; B01F 7/0025; B01F 7/00033; B01F 13/002; A47L 13/08; B44D 3/06; B44D 3/16

USPC ..... 15/236.01

See application file for complete search history.

(56) References Cited

U.S. PATENT DOCUMENTS

| | | | | |
|---|---|---|---|---|
| 1,605,138 A | | 11/1926 | Parks | |
| 2,524,475 A | | 10/1950 | Renz | |
| 2,526,863 A | | 10/1950 | Gilliam | |
| 2,860,858 A | * | 11/1958 | Kurs | B01F 13/002 15/236.03 |
| 3,719,993 A | * | 3/1973 | Caprioli | B44D 3/162 15/236.06 |
| 5,439,236 A | * | 8/1995 | Musil | B01F 7/001 366/605 |
| 7,788,760 B2 | * | 9/2010 | Schneble | B44D 3/164 15/236.01 |
| 2004/0177862 A1 | * | 9/2004 | Tennyson, Sr. | A47L 13/08 15/236.01 |

FOREIGN PATENT DOCUMENTS

EP 1279523 A1 1/2003

OTHER PUBLICATIONS

European Search Report No. 14193821.7-1704, dated Feb. 20, 2015.

* cited by examiner

*Primary Examiner* — Anshu Bhatia

(74) *Attorney, Agent, or Firm* — Miller, Matthias & Hull LLP

(57) ABSTRACT

A mixing paddle is described comprising a first section (2) adapted for mixing a paint, and a second section (3) having at least one removing edge (4), wherein the removing edge (4) has a geometry complementary to a horizontal cross section (5, 6) of the first section (2), and wherein the second section (3) is detachably attached, and a corresponding method for removing excess paint from a mixing paddle is described.

18 Claims, 2 Drawing Sheets

MIXING PADDLE

BACKGROUND

Technical Field

The present disclosure relates in general to a mixing paddle. More specifically, the present disclosure relates to a mixing paddle that can be used for mixing paints, varnish, lacquer, or shellac or in general any kind of viscous fluid which needs to be mixed before use.

Description of the Related Art

Paint is usually stored in cans for some time until the paint is finally applied. When paint is stored for a longer time, heavier sediments or pigments making up the paint will gather on the ground, so that mixing or stirring of the paint is required before the paint can be applied. Otherwise, the paint cannot be evenly applied, resulting in poor quality paintwork. Also, when blending differently colored paints together, it is necessary to thoroughly mix the resulting paint to obtain a homogenous mixture.

Traditionally, wooden sticks are used for mixing, i.e. stirring, paints. However, these sticks introduce impurities into the paint, resulting in a poor quality of the paint work. A more advanced mixing paddle, i.e. mixing stick, for mixing paints is shown in EP 1 279 523 A1. The problems associated with the use of wooden sticks are solved by a mixing paddle that is fabricated from injection molded plastic. In some embodiments, the mixing paddle can have through holes in its surface, so that the mixing paddle can be moved easier through the paint, which also enhances the mixing. Also, EP 1 279 523 A1 describes that the mixing paddle can comprise some curvature, which influences the fluid flow around the mixing paddle, such that vortices are created, which in turn enhance the mixing process.

As modern paints can be very expensive it is important to make sure that no paint is wasted. Unfortunately, it is difficult to regain excess paint that sticks to curved mixing paddles. This is because the paint sticking to the curvature cannot just be scraped off, for example at the rim of a paint can, like it would be possible with conventional flat mixing paddles.

EP 1 279 523 A1 describes in one embodiment a mixing paddle having a functionality similar to a carpet knife, where the paddle portion can be telescopically moved into the handle portion. As the paddle portion is telescopically moved into the handle portion, excess paint is removed from the paddle portion by a wiper surface that is included in the handle portion. Even though due to this mechanism excess paint can be removed from the paddle after use, such a mechanism is complicated, and thus expensive to manufacture. Especially, such a mechanism is not economically viable for mixing paddles that are intended for single use only.

SUMMARY OF THE DISCLOSURE

Therefore, there is a need for single use mixing paddles that can be quickly and cheaply cleaned from excess paint. This need is fulfilled by the mixing paddle and the corresponding method as defined in independent claims 1 and 13.

The mixing paddle according to the present disclosure comprises a first section adapted for mixing a paint, and a second section having at least one removing edge, wherein the removing edge has a geometry complementary to a horizontal cross section of the first section, and wherein the second section is detachably attached.

The first section that is adapted for mixing might have a substantially flat shape and in the vertical direction, i.e. in the direction of holding the mixing paddle, an elongated shape for pushing against the liquid paint. In the simplest case, the first section might have a planar, i.e. a rectangular horizontal cross section along its vertical length. However, alternatively, the horizontal cross section along the vertical length might be also non-planar, i.e. having a non-rectangular horizontal cross section along its vertical length. For example, the first section might be hollowed out along its vertical length, i.e. being made concave.

The second section can be detachably attached to the first section either directly or indirectly. For example, in case the second section is indirectly detachably attached to the first section, a third section can be located between the first section and the second section. The fact that the first section and the second section are detachably attached to one another allows the second section to become easily detached from the remainder of the mixing paddle. The detachable attachment of the first section to the second section or vice versa can be achieved by a perforation or tapering in the material of the mixing paddle. Hence, in a first state, the first section and the second section can be connected to each other and once the connection is broken at the perforation or tapering in the material, the first section and the second section are detached from one another. This kind of attachment is a non-reversible attachment. However, it is also possible that the attachment is reversible, such that the first section and the second section can be detached and later on be attached again.

The second section of the mixing paddle can be used for holding the first section during the mixing procedure. The second section can be an extension of the first section having substantially the same horizontal cross section than the first section.

Also, the second section has at least one removing edge, wherein the removing edge has a geometry complementary to the horizontal cross section of the first section. This means that the complementary geometry of the removing edge forms together with the geometry of the horizontal cross section of the first section a complete whole, i.e. providing the positive or negative shape to fit into the negative or positive shape, respectively, of the horizontal cross section of the first section. For example, if the first section is planar, i.e. having a rectangular horizontal cross section along its vertical length, then the geometry of the removing edge is also planar. However, as described above, the first section might also be non-planar, i.e. the first section might have a non-rectangular horizontal cross section along its length. For example, the horizontal cross section of the first section might be made concave. Then, in this example, the removing edge of the second section will have a convex geometry to interact with the concave cross section of the first section, or vice versa, where the horizontal cross section of the first section might be convex and the removing edge of the second section might be concave. Alternatively, the cross section of the first section might have convex and concave portions. Then the removing edge of the second section will be made correspondingly concave and convex to interact with the cross section of the first section.

The horizontal cross section of the removing edge itself, might be either planar, like the blade of a knife, or might have a horizontal cross section like the horizontal cross section of the first section. Also, the geometry complementary to the horizontal cross section of the first section is formed on the removing edge by corresponding recesses and protrusions in the material. The recesses and protrusion in the removing edge might be pointed, i.e. sharpened, or just being blunt.

Once the user is done with mixing, the user may simply detach the second section, and align the removing edge to the horizontal cross section of the first section for removing the excess paint that is on the first section of the mixing paddle by moving the removing edge along the length of the first section. For example, this is done from the top down, i.e. the user moves the removing edge towards the end of the first section facing the paint can or reservoir where the excess paint is being collected. The angle of alignment between removing edge and first section can be arbitrarily chosen. However, in case that the first section has a non-rectangular horizontal cross section due to recesses and protrusions, there may be one or two angles with which the removing of the excess paint could be achieved most efficiently. Once one side, e.g. the front side of the first section is cleaned, the user may simply turn over the first section from its front side to its back side where the process is repeated until all excess paint, or at least most of the excess paint is removed from the back side of the first section as well. Advantageously, excess paint can be efficiently removed from the first section of the mixing paddle after use by using the removing edge of the second section that corresponds to the horizontal cross section of the first section of the mixing paddle. For example, this can be done by moving the second section along the length of the first section while the geometry of the removing edge having the complementary geometry of the first section interacts with the first section. Also, by detaching a section of the mixing paddle there is no need to use any separate cleaning tools that must be individually stored, transported or even cleaned themselves. After cleaning, both the second and the first section, i.e. the remainder of the mixing paddle can be simply disposed of.

In one embodiment, the at least one removing edge is opposite to the edge that results from detaching the second section. This manner of locating the at least one removing edge has the advantage that the geometry, i.e. shape, of the removing edge does not constrict the user during mixing. For example, during mixing the user will most likely hold the mixing paddle at the sides of the second section. However, in the present case the removing edge having the complementary geometry is the edge that points towards the user, since the edge that will result from detaching the second section is the edge that points towards the first section. Therefore, the user will most likely not hold the mixing paddle at the edge that points towards him. However, alternatively, the removing edge having the complementary geometry can also be the edge that results from detaching the part of the second section, or in another alternative one or both of the side edges of the second section can also have the complementary geometry.

In another embodiment the second section is detachably attached by means of a perforation in the material of the mixing paddle. This perforation can be introduced during manufacturing of the mixing paddle, where small openings in the material of the mixing paddle are introduced. For example, these openings might be already introduced in the mold so that the resulting casted mixing paddle has corresponding perforation openings in its material. These openings can, for example, be arranged in a straight line for easy tearing, or can be arranged so that the breaking edge, i.e. the edge that results from detaching the second portion, has some specific geometry. For example, the breaking edge may have the complementary geometry to the horizontal cross section of the first section of the mixing paddle, as described above, so that the breaking edge can be used as removing edge.

Further, in yet another embodiment the second section is detachably attached by means of a tapering in the material of the mixing paddle. Here, the term "tapering" refers to a reduction of material forming the area where the second section is detachably attached. For example, the second section is detachably attached by making the section where the second section is detachably attached less rigid compared to the surrounding material. This can be done so that the second section can break off easily.

In another embodiment at least a part of the first section has a non-rectangular horizontal cross section. Advantageously, as already described above, the first section of the mixing paddle that is adapted for mixing the paint can have some curvature along its length to further create a vortex to enhance mixing. The first section of most conventional mixing paddles is generally even, i.e. planar, resulting in a rectangular horizontal cross section. However, a curvature results in a non-rectangular horizontal cross section.

In one embodiment at least the part of the first section of the mixing paddle has a curved cross section. For example, the horizontal cross section of the first section might be concave. However, also differently curved shapes are possible. In another embodiment at least the part of the first section of the mixing paddle has an s-shaped horizontal cross section. Such an s-shaped horizontal cross section might be created by coiling the otherwise substantially rectangular and planar surface of the first section of the mixing paddle into an s-shape so that the resulting horizontal cross section is also s-shaped. In another embodiment at least the part of the first section of the mixing paddle has an z-shaped horizontal cross section. However, the horizontal cross section might be also an intermediate between s-shape and z-shape.

In another embodiment the first section comprises at least one through hole. By introducing through holes in the first section of the mixing paddle the resistance experienced by the user while mixing paint is reduced as well as better mixing results can be achieved. For example, these through holes might be circular, or may have any geometrical shape such as being elliptical, or being shaped like a water drop.

In another embodiment the second section is detachably attached to the first section. Advantageously, the second section can be used as a handle for holding the first section when the first section is used for mixing. Therefore, in yet another embodiment, the second section comprises a plurality of reinforcements spaced along the length of the second section. These reinforcements might be simple thickenings in the material of the second section or geometrical structures such as fins interlinking part of the horizontal cross section of the second section. These reinforcements help to improve the overall physical strength of the second section and also allow better handling of the mixing paddle, i.e. these reinforcements allow the user to get a better grip during mixing. However, additionally, at least part of the first section might also comprise these reinforcements, so that a user can also better hold the first section directly.

In another embodiment the mixing paddle is made of recycled synthetic material. Advantageously, this material provides an environmentally friendly alternative to organic materials such as wood.

In yet another embodiment a method for removing excess paint from a mixing paddle is described. The mixing paddle used comprises a first section adapted for mixing a paint, and a second section having at least one removing edge, wherein the removing edge has a geometry complementary to a horizontal cross section of the first section, the method comprises detaching the detachably attached second section, and moving the removing edge along a length of the first section of the mixing paddle to remove excess paint.

BRIEF DESCRIPTION OF THE DRAWINGS

In the following the mixing paddle according to the present disclosure is further described by reference to the schematic illustrations shown in the figures, wherein.

It should be understood that the drawings are not necessarily to scale and that the disclosed embodiments are sometimes illustrated diagrammatically and in partial views. In certain instances, details which are not necessary for an understanding of the disclosed methods and apparatus or which render other details difficult to perceive may have been omitted. It should be understood, of course, that this disclosure is not limited to the particular embodiments illustrated herein.

DETAILED DESCRIPTION

Figures 1A, 1B, 1C, 1D:
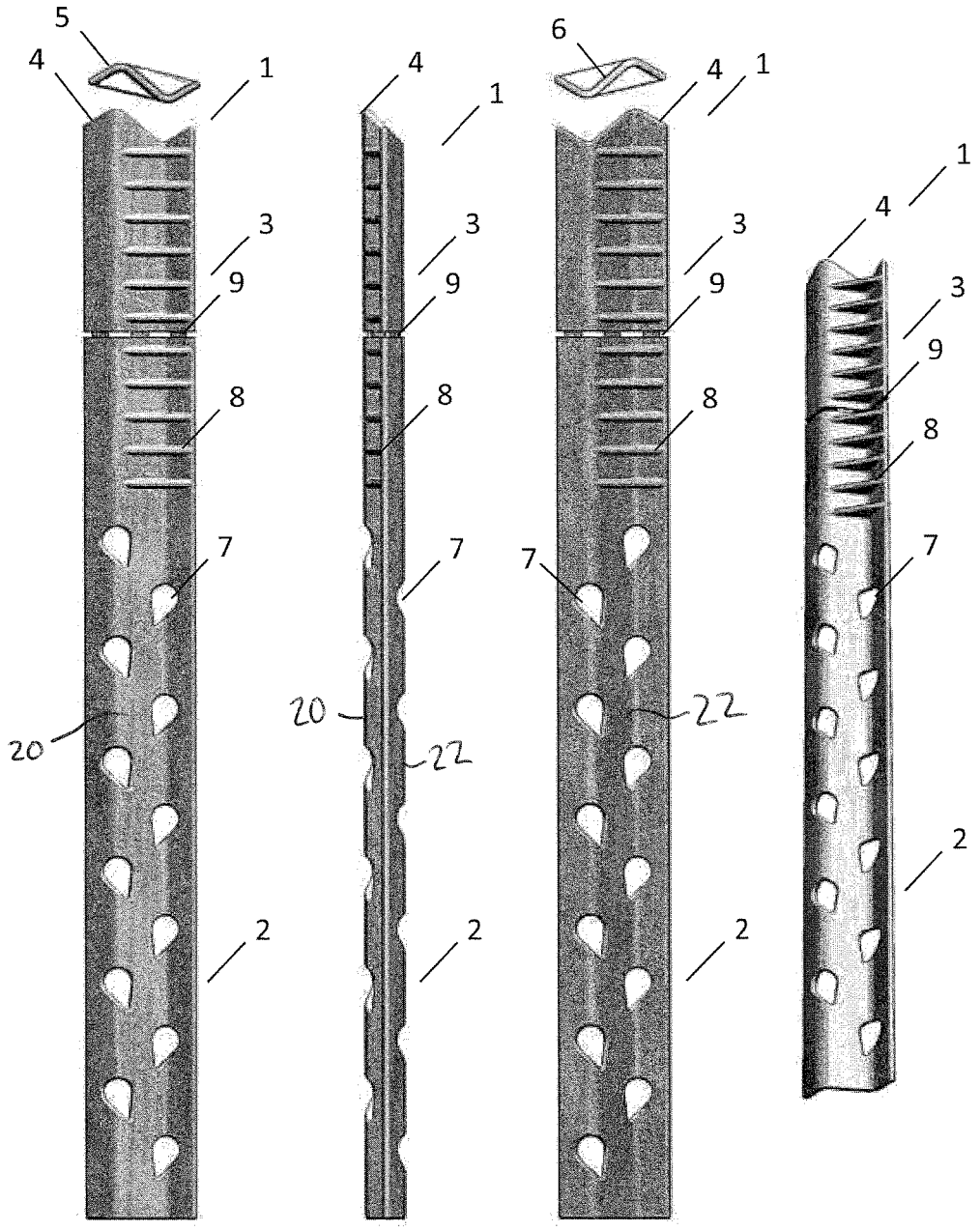
FIGS. 1*a-d* are different views of an embodiment of a mixing paddle according to the present disclosure.

FIGS. 1*a-d* show different views (front-, side-, back-, top-, end-, and dimensional view) of an embodiment of a mixing paddle 1 according to the present disclosure with a first section 2 adapted for mixing a paint and a second section 3 having a removing edge 4. The horizontal cross sections 5, 6 are schematically indicated on the very top in FIGS. 1*a* and 1*c*, where FIG. 1*a* shows the front side 20 of the mixing paddle 1, and whereas FIG. 1*c* shows the back side 22 of the mixing paddle 1. As it can be seen in the Figures, the geometry of the removing edge 4 is complementary to the horizontal cross section 5, 6 of the first section 2 extending in the vertical direction. Advantageously, that allows fitting the removing edge 4 into the geometry, i.e. into the profile, of the first section.

In the here shown embodiment the first section 2 comprises several openings such as opening 7 in its material. These openings allow easier and more efficient mixing of the paints. The openings in FIGS. 1*a-d* are disposed throughout the first section 2 and are tear-shaped. However, this example shall not be limiting and it is evident for a person skilled in the art that the openings can have any shape, such as circular or rectangular, and are disposed in any pattern on the first section 2. Also, in the embodiment as shown in FIGS. 1*a-d* the cross section 5, 6 of the first section 2 is s-shaped. However, in alternative embodiments the cross section may be also rectangular, convex/concave, having a V-shape, etc.

FIGS. 1*a-d* also show enforcements like enforcement 8 being arranged along the vertical length of the second section 3 and partly along the length of the first section 2. The here shown enforcements 8 are in the shape of fins that are located in the s-shaped horizontal cross-section 5, 6. Advantageously, these enforcements 8 add extra stability to the mixing paddle as well as they are being helpful for the user to reliably hold the mixing paddle 1, even when the entire mixing paddle is covered with slippery paint.

In the here shown embodiments it is shown that the first section 2 and the second section 3 are hold together by a perforated strip 9. If the user starts bending the first section 2 and the second section 3 relative to each other, both parts will break apart along the perforation strip 9. However, the person skilled in the art would also know alternative ways how the second section 3 could be detached from the first section 2 such as for example by thinning the material along the strip, i.e. tapering the material.

Figure 2A:
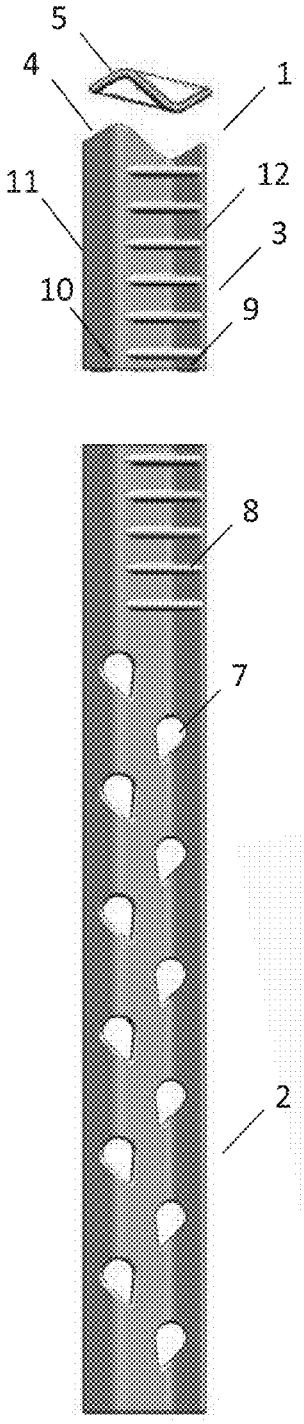
FIG. 2*a* is a front view of a mixing paddle according to the present disclosure with the second section detached.

FIG. 2*a* shows, like FIG. 1*a*, the front view of the mixing paddle 1. In the here shown example, the second section 3 is detached from the first section 2. As already described above, this can be done by bending both sections 2, 3 relative to each other until they break apart along the perforation strip 9. FIG. 2*a* shows that both sections 2, 3 are separated from each other along a straight horizontal line leaving an edge 10 in the second section 3 opposite the removing edge 4. Alternatively, however, the edge 10 could also, or instead, have the geometry of the removing edge 4. The geometry of the removing edge could also be realized on either or both sides 11, 12 of the second section 3.

Figure 2B:
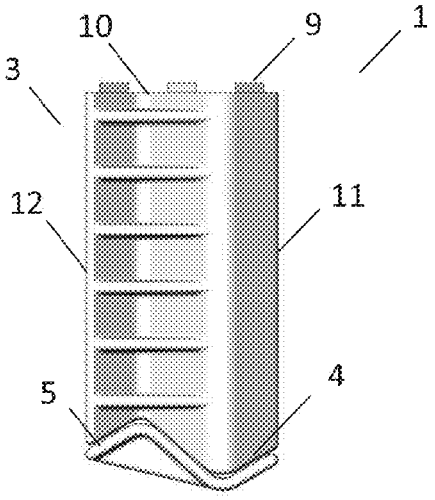
FIG. 2*b* is a front view of a mixing paddle according to the present disclosure where the removing edge of the second section is aligned with the first section.
Figure 2C:
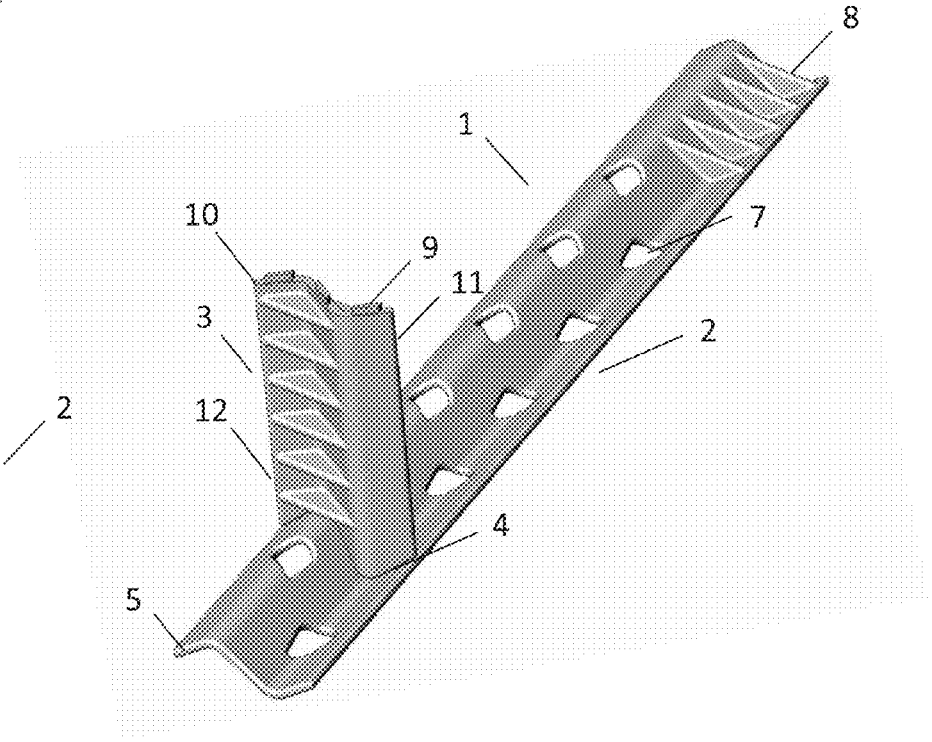
FIG. 2*c* is a dimensional view of a mixing paddle according to the present disclosure where the removing edge of the second section is aligned with the first section.

FIGS. 2*b* and 2*c* show a front view and a dimensional view of the mixing paddle 1 where the removing edge 4 of the second section 3 is aligned with the cross section 5, 6 of the first section 2.

After the second section 3 was detached, the user can hold the first section 2, preferably on the very top part where there is no or less paint. For removing the excess paint the removing edge 4 is simply aligned with the horizontal cross section 5, 6 of the first section 2, i.e. the removing edge 4 having a geometry complementary to the horizontal cross section 5, 6 of the first section 2 is simply pushed into the horizontal cross section 5, 6 of the first section 2.

For removing the excess paint, the removing edge 4 is moved down along the length of the first section 2 to scrape the paint off. Advantageously, when the removing edge 4 is moved down along the length of the first section 2 for the first time most of the excess paint can be already removed from the first section 2 due to the drop shaped through holes 7 in the first section 2. The removing edge 4 can be moved down along the length of the first section 2 more than once to make sure that as much excess paint as possible is being collected.

The first section 2 can be then turned over to its back side where the process is repeated until all excess paint, or at least most of it is also removed from the back side of the first section 2.

All references, including publications, patent applications, and patents, cited herein are hereby incorporated by reference. The description of certain embodiments as "preferred" embodiments, and other recitation of embodiments, features, or ranges as being preferred, is not deemed to be limiting, and the claims are deemed to encompass embodiments that may presently be considered to be less preferred. All methods described herein can be performed in any suitable order unless otherwise indicated herein or otherwise clearly contradicted by context. The use of any and all examples, or exemplary language (e.g., "such as") provided herein, is intended to illuminate the disclosed subject matter and does not pose a limitation on the scope of the claims. Any statement herein as to the nature or benefits of the exemplary embodiments is not intended to be limiting, and the appended claims should not be deemed to be limited by such statements. More generally, no language in the specification should be construed as indicating any non-claimed element as being essential to the practice of the claimed subject matter. The scope of the claims includes all modifications and equivalents of the subject matter recited therein as permitted by applicable law. Moreover, any combination of the above-described elements in all possible variations thereof is encompassed by the claims unless otherwise indicated herein or otherwise clearly contradicted by context. The description herein of any reference or patent, even if identified as "prior," is not intended to constitute a concession that such reference or patent is available as prior art against the present disclosure.

What is claimed is:

1. A mixing paddle comprising:

a first section adapted for mixing a paint, the first section including an edge, a front side, and a back side, wherein the front side and the back side define a horizontal cross section of the first section; and a second section frangibly coupled to the edge of the first section, the second section having at least one removing edge, wherein the removing edge has a geometry complementary to an entirety of the front side of the horizontal cross section of the first section.

2. The mixing paddle of claim 1, wherein the at least one removing edge is opposite to an edge of the second section that results from detaching the second section from the first section.

3. The mixing paddle of claim 1, wherein the second section is detachably coupled to the first section by a perforation in the mixing paddle.

4. The mixing paddle of claim 1, wherein the second section is detachably coupled to the first section by a tapering in the mixing paddle.

5. The mixing paddle of claim 1, wherein at least a part of the first section has a non-rectangular horizontal cross section.

6. The mixing paddle of claim 1, wherein at least a part of the first section of the mixing paddle has a curved horizontal cross section.

7. The mixing paddle of claim 1, wherein at least a part of the first section of the mixing paddle has an s-shaped horizontal cross section.

8. The mixing paddle of claim 1, wherein at least a part of the first section of the mixing paddle has a z-shaped horizontal cross section.

9. The mixing paddle of claim 1, wherein the first section comprises at least one through hole.

10. The mixing paddle of claim 1, wherein the second section comprises a plurality of reinforcements spaced along a length of the second section.

11. The mixing paddle of claim 1, wherein the mixing paddle is made of recycled synthetic material.

12. The mixing paddle of claim 1, wherein the geometry of the removing edge is further complementary to an entirety of the back side of the horizontal cross section of the first section.

13. A mixing paddle comprising:

a first section adapted for mixing a paint, the first section including an edge, a front side, and a back side, wherein the front side and the back side define a horizontal cross section of the first section, and wherein at least a part of the first section has a non-rectangular horizontal cross section; and a second section detachably coupled to the edge of the first section, the second section having at least one removing edge, wherein the removing edge has a geometry complementary to an entirety of the front side of the horizontal cross section of the first section.

14. The mixing paddle of claim 13, wherein at least a part of the first section of the mixing paddle has a curved horizontal cross section.

15. The mixing paddle of claim 13, wherein at least a part of the first section of the mixing paddle has a s-shaped horizontal cross section.

16. The mixing paddle of claim 13, wherein the geometry of the removing edge is further complementary to an entirety of the back side of the horizontal cross section of the first section.

17. A mixing paddle comprising:

a first section adapted for mixing a paint, the first section including an edge, a front side, and a back side, wherein the front side and the back side define a horizontal cross section of the first section, and wherein at least a part of the first section of the mixing paddle has an s-shaped horizontal cross section; and a second section detachably coupled to the edge of the first section, the second section having at least one removing edge, wherein the removing edge has a geometry complementary to an entirety of the front side of the horizontal cross section of the first section.

18. The mixing paddle of claim 17, wherein the geometry of the removing edge is further complementary to an entirety of the back side of the horizontal cross section of the first section.

* * * * *